United States Patent [19]

Flanigan

[11] Patent Number: 4,922,582

[45] Date of Patent: May 8, 1990

[54] STRAP SHORTENING DEVICE

[76] Inventor: Larry L. Flanigan, 7 Rowland Dr., East Hartford, Conn. 06118

[21] Appl. No.: 375,915

[22] Filed: Jul. 5, 1989

[51] Int. Cl.[5] ..... A44B 11/00

[52] U.S. Cl. ..... 24/71.1; 24/198; 24/200

[58] Field of Search ..... 24/71.1, 71.2, 71.3, 24/198, 199, 200, 169, 68 F, 30.5 S, 115 H, 129 A

[56] References Cited

U.S. PATENT DOCUMENTS

| | | | |
|---|---|---|---|
| 139,524 | 6/1873 | Straus | 24/199 |
| 293,689 | 2/1884 | Usborne | 24/129 A |
| 1,675,040 | 6/1928 | Mix . | |
| 2,012,466 | 8/1935 | Goldsmith et al. | 24/198 |
| 2,260,060 | 10/1941 | Shaulson | 24/200 |
| 2,713,708 | 7/1955 | Anderson | 24/198 |
| 3,075,268 | 1/1963 | Schwartz | 24/200 |
| 3,858,279 | 1/1975 | Brattstrom | 24/200 |
| 4,038,726 | 8/1977 | Takabayashi | 24/198 |
| 4,296,531 | 10/1981 | Bengtsson | 24/200 |
| 4,571,783 | 2/1986 | Kasai | 24/200 |
| 4,823,443 | 4/1989 | Waters | 24/71.2 |

*Primary Examiner*—Victor N. Sakran

*Attorney, Agent, or Firm*—Ira S. Dorman

[57] ABSTRACT

A device for use in reducing the effective length of an endless strap, such as on a pocketbook, consists of a body having a number of pairs of aligned stub elements along opposite sides of a cavity defined therewithin. The strap is inserted through slots formed in end portions of the body, to lie within channels extending therethrough, and is threaded about and affixed upon the crosspiece structures provided.

15 Claims, 3 Drawing Sheets

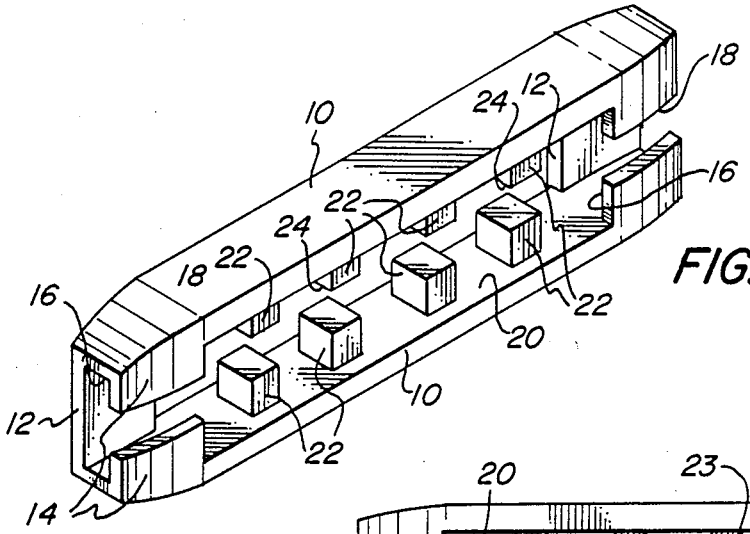
FIG. 1
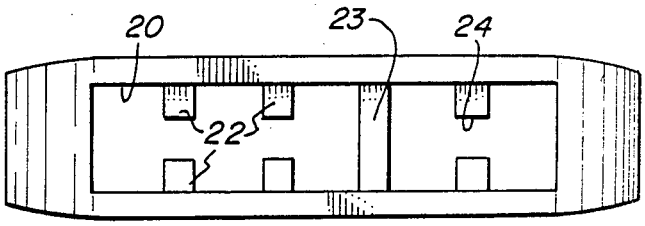
FIG. 7
FIG. 2
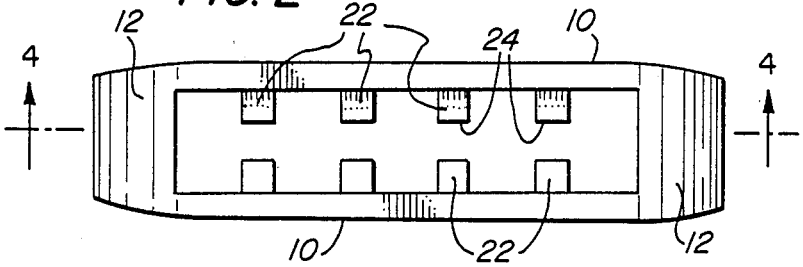
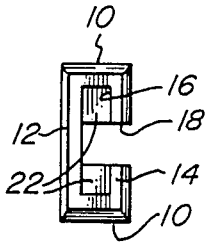
FIG. 6
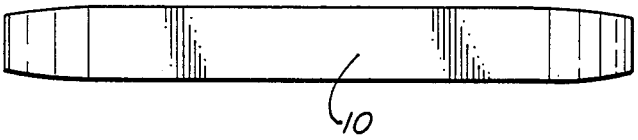
FIG. 3
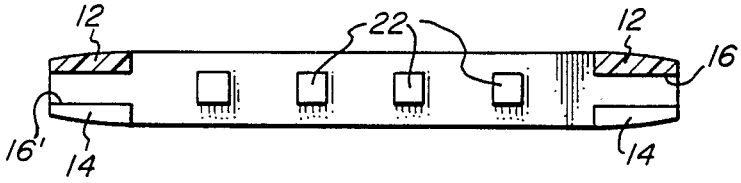
FIG. 4
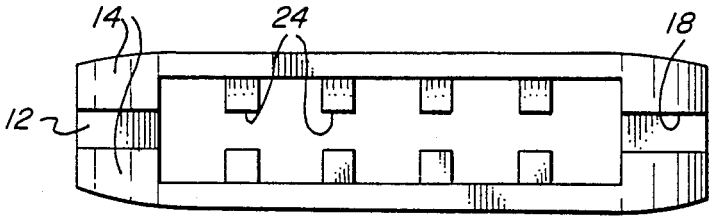
FIG. 5

STRAP SHORTENING DEVICE

BACKGROUND OF THE INVENTION

It is of course common practice to provide adjustable-length shoulder straps on women's pocketbooks and the like, as by using a sliding buckle or similar arrangement. In many instances however the strap is not provided with means for adjusting its effective length, and it is therefore the broad object of the present invention to provide a novel device that is adapted to that purpose.

Moreover, it is often the case that the ends of a pocketbook strap are permanently affixed to the purse, thereby making the addition of parts that are conventionally used for adjustment difficult or, indeed, impossible to achieve. Consequently, it is a more specific object of the invention to provide a novel strap-shortening device that can be installed onto a strap that is devoid of free ends.

Further objects of the invention are to provide such a device which is of relatively simple and inexpensive design and construction, is relatively easy to put into place on the strap, and which also affords aesthetic attributes and a wide latitude of length variation. Additional objects are to provide a novel assembly of a strap and a device having the foregoing features and advantages.

The prior art describes a wide variety of buckles and other fasteners used for different kinds of straps and belts. Typical are the elements shown in Mix U.S. Pat. No. 1,675,040; Goldsmith et al U.S. Pat. No. 2,012,466; Anderson U.S. Pat. No. 2,713,708; Takabayashi U.S. Pat. No. 4,038,726; Bengtsson U.S. Pat. No. 4,296,531 and Kasai U.S. Pat. No. 4,571,783. None of the foregoing fasteners is however adapted to achieve the objectives of the present invention, hereinabove set forth.

SUMMARY OF THE INVENTION

It has now been found that certain of the foregoing and related objects of the invention are attained by the provision of a device comprising a body having end portions and opposite sidewall portions, defining a cavity, and front and rear face portions opening thereinto. Both of the end portions of the body have a channel therethrough between the cavity and the corresponding end of the body, and each has a slot through the rear face portion, along its entire length. The channels are substantially aligned with one another, and the slots are narrower than the channels and open into them. The body also has a plurality of crosspiece structures traversing the cavity and disposed at spaced points along the sidewall portions; at least one of the crosspiece structures is comprised of a pair of transversely aligned stub elements, spaced from one another to define a gap between their confronting ends.

The body of the device will normally be elongated, with the end portions thereof disposed at its opposite ends and along its longitudinal axis. The cavity of the device will also be elongated along the longitudinal axis of the body, and the channels and slots will be disposed thereon; generally, the cavity, the channels, and the slots will be of substantially uniform width along their lengths. The crosspiece structures will preferably have outer surfaces lying at levels below the front and rear face portions of the body, thereby providing shallow recesses therealong.

Usually, there will be at least three crosspiece structures present in the device, and in some cases it will be desirable for one of the structures to be a one-piece element extending between the sidewall portions. The body will advantageously be of integrally formed, unitary construction, such as may conveniently be molded from a synthetic resinous material.

Other objects of the invention are attained by the provision of an assembly of an elongated strap member and a device constructed as hereinabove described. As installed thereon the strap member will have an intermediate portion disposed within the cavity of the body of the device, with portions adjacent the intermediate portion, and lying to opposite sides thereof, extending through the channels. The intermediate portion will pass, in double-ply relationship, in front of a crosspiece structure that is close to a first end portion of the body; it will be disposed about another of the structures, and be affixed on one of the crosspiece structures that is provided by an aligned pair of stub elements, by looping it thereabout.

In the assembly, the "one" and the "another" crosspiece structures may be provided by the same structure. The intermediate portion of the strap may pass, in double-ply relationship, about the "another" crosspiece structure, with the "one" structure being other than the "another" structure. The assembly is utilized to greatest advantage when the strap member is devoid of a free end, and hence the preferred assembly will include such a strap member.

BRIEF DESCRIPTION OF THE DRAWINGS

FIG. 1 is a perspective view of a device embodying the present invention;

FIG. 2 is a view of the front of the device, drawn to a scale somewhat reduced from that of FIG. 1;

FIG. 3 is a side view of the device;

FIG. 4 is a section view thereof, taken along line 4—4 of FIG. 2;

FIG. 5 is a rear view of the device;

FIG. 6 is an end view thereof;

FIG. 7 is a front view of a slightly modified embodiment of the strap shortening device;

DETAILED DESCRIPTION OF THE ILLUSTRATED EMBODIMENTS

Figure 8:
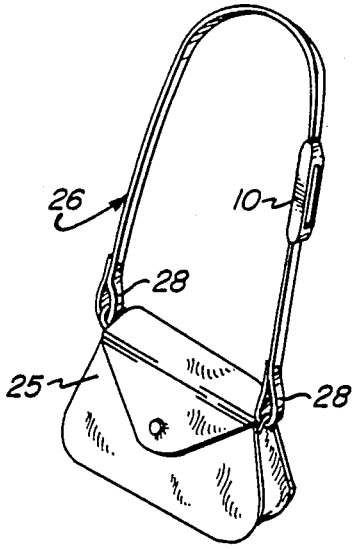
FIG. 8 is a perspective view of an assembly embodying the invention, including a pocketbook, having a shoulder strap onto which the device of FIGS. 1-6 has been installed, the Figure being drawn to a greatly reduced scale.

Turning now in detail to FIGS. 1–6 of the appended drawings, therein illustrated is a device embodying the present invention, molded from a synthetic resinous material to be of integrally formed, one-piece construction. The device consists of an elongate body having sidewall portions 10, front face portions 12 connecting the opposite ends of the sidewall portions 10, and rear face portions 14 extending inwardly toward one another over the front face portions 12; rectangular channels 16, 16', accessible through longitudinal slots 18, are thereby cooperatively defined. The elements of which the body is constructed define a relatively large, generally rectangular cavity 20, into which project, from each of the opposite sidewall portions 10, four stub elements 22. The stub elements are transversely aligned in pairs spaced along the length of the cavity 20, and their opposing end faces are separated from one another so as to define a gap 24 between the elements of each pair. Considered from front-to-back, the stub elements are thinner than is the remainder of the body, as a result of which recess sections 20' (FIG. 11) are defined within the cavity along the front and rear of the body.

A slight variation in the construction hereinabove described is shown in FIG. 7. In accordance therewith only three pairs of stub elements 22 are provided; the fourth crosspiece structure 23 is of unitary form, and serves a strengthening function (as may be desirable in instances in which the strength of the front face portions 12 may be deemed inadequate).

FIGS. 8, 10C, 12 and 13 show the device of FIGS. 1–6 installed on the shoulder strap, generally designated by the numeral 26, of a pocketbook. It will be noted from FIG. 8 that the opposite end portions 28 of the strap 26 are permanently affixed to rings on the purse 25, such as by rivets or the like.

Figure 9:
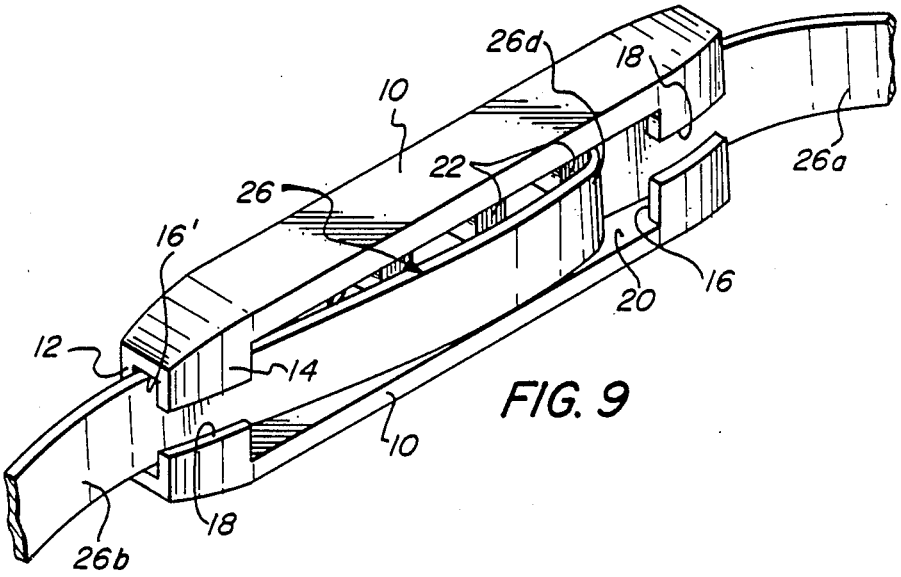
FIG. 9 is a fragmentary perspective view of the assembly of FIG. 8, drawn to the scale of FIG. 1 and showing the section of the strap on which the device of the invention is installed.
Figure 11:
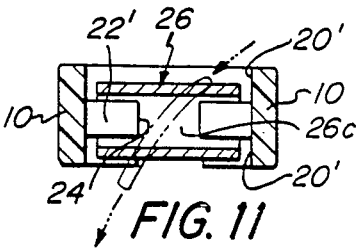
FIG. 11 is a sectional view, taken along line 11—11 of FIG. 10B, depicting in phantom line the step of the threading procedure by which the strap is inserted through the gap between the stub elements of the crosspiece structure thereat.
Figure 10A:
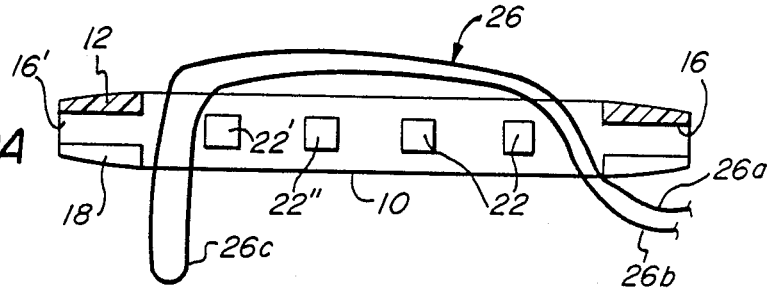
FIGS. 10A-10C are sectional views taken along line 4—4 of FIG. 2, illustrating a sequence of steps by which the device may be installed on the strap.
Figure 10B:
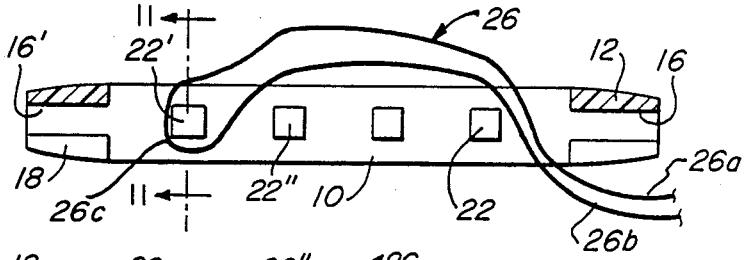
Figure 10C:
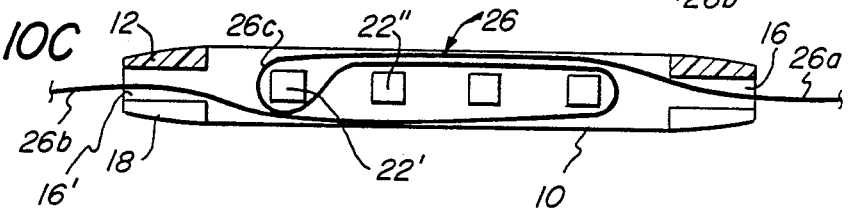

In the sequence of installation illustrated in FIGS. 10A–10C, the shortening device is engaged upon the strap 26 by initially forming the latter into a loop (consisting of plies "a" and "b", and crook portion "c"), inserting the loop through the space adjacent the channel 16 at one end of the body; and threading it in front of the crosspiece structures; this phase is shown in FIG. 10A. The loop is then engaged over the most remote crosspiece structure (comprised of stub elements 22') by passing the crook portion "c" downwardly (in the orientation illustrated) through the gap 24 between the ends of the stub elements. The upper ply **26*a* of the strap is inserted into the channel 16 at the first end, through the corresponding slot 18, and the other ply 26*b* is reversed over the crosspiece structures and inserted through the slot 18 at the opposite end of the body to dispose it within the channel 16', thereby producing the configuration shown in FIGS. 9 and 10C. FIG. 11 shows (in phantom line) the crook portion 26*c* of the strap being passed through the gap 24 between the stub elements 22', to produce the relationship of FIG. 10B (and the full-line condition of FIG. 11**).

Figure 12:
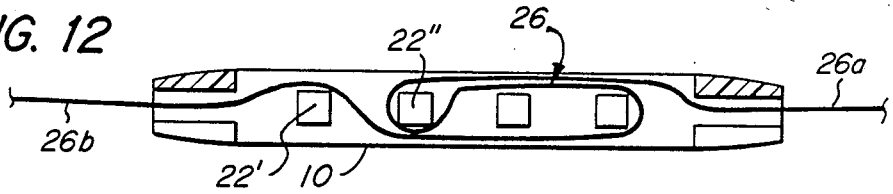
FIGS. 12 and 13 are sectional views, again taken along line 4—4 of FIG. 2, showing a second and a third configuration by which the strap may be threaded for installation of the device.

Turning now to FIG. 12, therein illustrated is a second threading configuration of the strap 26 within the shortening device, wherein the crook portion is engaged upon one of the two intermediate crosspiece structure, comprised of stub elements designated 22''. The extent of reduction in effective length thereby achieved is of course somewhat less than that which is afforded by the configuration depicted in FIGS. 9 and 10C. It will be noted that the strap portion **26*b* passes about element 22' from the rear of element 22'', so as to hide element 22'** when viewed from the front of the device; this of course contributes to the aesthetics of the assembly.

Figure 13:
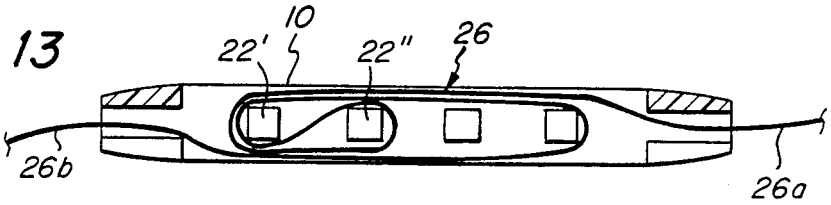

Turning finally to FIG. 13, the threading configuration shown produces greater length reduction than that which is achieved with the configuration of FIGS. 9 and 10C. This results because the strap loop is taken about the endmost elements 22' in double-ply condition before being engaged upon the elements 22''. As will be self-evident, a variety of threading arrangements other than those shown may of course be employed.

Although the elongate shape of the device illustrated may be preferred in most instances, it will be understood that the device is suited to fabrication in any of numerous other forms and shapes. Similarly, while a one-piece plastic body will often be most advantageous, the device may of course be made from a wide variety of materials, and of several separate parts, if so desired. The number of crosspiece structures present may also deviate from that of the illustrated embodiments, although it will readily be appreciated that at least two such components must be present. Finally, it should be noted that provision of the crosspiece structures that are thin (in front-to-rear dimension) relative to the overall thickness of the body produces recesses along the front and rear of the cavity. Sections of the strap are desirably accommodated therewithin, to thereby avoid or minimize protrusions beyond the front and rear planes of body faces; this of course contributes to the aesthetics of the assembly, but is not an essential functional feature of the device.

Thus, it can be seen that the present invention provides a novel device for adjusting the effective length of the strap on a woman's pocketbook or the like, which can readily be installed despite the absence of a free end on the strap. The device is of relatively simple and inexpensive design and construction, is relatively easy to put into place, and affords aesthetic attributes and a wide latitude of length variation. The invention also provides a novel assembly consisting of such a device, in combination with a strap.

Having thus described the invention, what is claimed is:

1. A device for use in reducing the effective length of a strap or the like, comprising a body having end portions with a cavity defined therebetween, said body having a front face portion and a rear face portion opening to said cavity, and having opposite sidewall portions extending therealong, both of said end portions having a channel therethrough between said cavity and the end of said body thereat, and having a slot through said rear face portion along the entire length thereof, said channels being substantially aligned with one another and said slots being narrower than said channels and opening thereinto, said body also having a plurality of crosspiece structures traversing said cavity and disposed at spaced points along said sidewall portions, at least one of said structures being comprised of a pair of transversely aligned stub elements, spaced from one another to define a gap between confronting ends thereof.

2. The device of claim 1 wherein said body is elongated, wherein said end portions are at opposite ends along the longitudinal axis thereof, wherein said cavity is elongated along said longitudinal axis of said body, and wherein said channels and slots are disposed on said longitudinal axis.

3. The device of claim 2 wherein said cavity, said channels, and said slots are of substantially uniform width along their lengths.

4. The device of claim 1 wherein said crosspiece structures have outer surfaces lying at levels below said front and rear face portions of said body, providing shallow recesses therealong.

5. The device of claim 1 wherein there are at least three of said crosspiece structures.

6. The device of claim 5 wherein one of said crosspiece structures is comprised of a single, unitary element extending between said sidewall portions.

7. The device of claim 1 wherein said body is of integrally formed, one-piece construction.

8. The device of claim 7 wherein said body is molded of a synthetic resinous material.

9. An assembly of an elongated strap member and a device for reducing the effective length thereof, said device comprising a body having first and second end portions with a cavity defined therebetween, said body having a front face portion and a rear face portion opening to said cavity, and having opposite sidewall portions extending therealong, both of said end portions having a channel extending therethrough between said cavity and the end of said body thereat, and having a slot through said rear face portion along the entire length thereof, said channels being substantially aligned with one another and said slots being narrower than said channels and opening thereinto, said body also having a plurality of crosspiece structures traversing said cavity and disposed at spaced points along said sidewall portions, at least one of said structures being comprised of a pair of transversely aligned stub elements, spaced from one another to define a gap between confronting ends thereof; said strap member having an intermediate portion disposed within said cavity of said body, and having portions adjacent said intermediate portion, lying to opposite sides thereof, extending through said channels of said body end portions, said intermediate portion passing, in double-ply relationship, in front of a crosspiece structure close to said first end portion, being disposed about another of said structures, and being affixed on said one structure by looping it thereabout.

10. The assembly of claim 9 wherein said strap member is devoid of a free end.

11. The assembly of claim 9 wherein said close crosspiece structure is the structure closest to said first end portion.

12. The assembly of claim 9 wherein said one and said another crosspiece structures are the same structure.

13. The assembly of claim 12 wherein said same structure is the crosspiece structure closest to said second end portion of said body.

14. The assembly of claim 9 wherein said intermediate portion of said strap passes in double-ply relationship about said another crosspiece structure, said one structure being other than said another structure.

15. The assembly of claim 14 wherein said one crosspiece structure is other than the structure that is closest to said second end portion.

* * * * *